US012532968B1

(12) United States Patent
Peng

(10) Patent No.: US 12,532,968 B1
(45) Date of Patent: Jan. 27, 2026

(54) SOFA

(71) Applicant: Wenhe Peng, Guangdong (CN)

(72) Inventor: Wenhe Peng, Guangdong (CN)

( * ) Notice: Subject to any disclaimer, the term of this patent is extended or adjusted under 35 U.S.C. 154(b) by 0 days.

(21) Appl. No.: 19/268,018

(22) Filed: Jul. 14, 2025

(30) Foreign Application Priority Data

Jun. 27, 2025 (CN) ..... 202521352302.5

(51) Int. Cl.

| | |
|---|---|
| ***A47C 4/02*** | (2006.01) |
| ***A47C 7/54*** | (2006.01) |
| ***A47C 13/00*** | (2006.01) |
| ***A47C 17/00*** | (2006.01) |
| ***A47C 17/86*** | (2006.01) |

(52) U.S. Cl.
CPC ..... *A47C 17/86* (2013.01); *A47C 4/02* (2013.01); *A47C 7/546* (2013.01); *A47C 17/00* (2013.01); *A47C 13/005* (2013.01)

(58) Field of Classification Search
CPC ..... A47C 4/02; A47C 7/546; A47C 13/005; A47C 17/00; A47C 17/86
See application file for complete search history.

(56) References Cited

U.S. PATENT DOCUMENTS 2,605,820 A * 8/1952 Powellek ..... F16B 12/26 297/411.27
3,170,729 A * 2/1965 Grant ..... A47C 7/30 297/411.27
3,608,959 A * 9/1971 Sarvas ..... A47C 4/028 297/440.15
3,973,800 A * 8/1976 Kogan ..... A47C 7/002 297/248 X
4,022,502 A * 5/1977 Smith ..... A47C 17/12 297/411.23 X
4,209,198 A * 6/1980 Apple, Sr. ..... A47C 4/02 297/448.1
4,437,704 A * 3/1984 Hovsepians ..... A47C 4/02 297/440.14 X
5,000,512 A * 3/1991 Laird ..... A47C 4/028 297/440.1 X
5,551,757 A * 9/1996 Glover ..... A47C 4/02 297/440.15 X (Continued)

FOREIGN PATENT DOCUMENTS

DE 202004008408 U1 * 8/2004 ..... A47C 4/028
DE 102014103537 A1 * 9/2015 ..... F16B 12/42

(Continued)

*Primary Examiner* — Rodney B White

(57) ABSTRACT

A sofa includes a base, an armrest, and a mounting bracket. The armrest is positioned on the base. The mounting bracket is used for connecting the armrest to the base, so that the armrest and the base are combined into a whole. A bottom portion of the mounting bracket abuts against a bottom surface of the base. A side wall of the mounting bracket abuts against a side surface of the base and a side surface of the armrest. A first sleeving opening, a second sleeving opening, and a third sleeving opening are arranged in sequence and correspond in position. One end of a second support rod and one end of a third support rod pass through the first sleeving opening, the second sleeving opening, and the third sleeving opening in sequence and are connected to the first support rod, so that the base and the armrest form a whole.

19 Claims, 5 Drawing Sheets

(56) References Cited

U.S. PATENT DOCUMENTS 5,601,340 A * 2/1997 Stout ..... A47C 4/02 297/440.1 X
5,709,500 A * 1/1998 Mizelle ..... A47C 4/02 403/3
5,738,414 A * 4/1998 Wieland ..... A47C 4/02 297/440.1
6,241,317 B1 * 6/2001 Wu ..... A47C 4/02 297/440.1
6,367,880 B1 * 4/2002 Niederman ..... A47C 4/02 297/440.14 X
6,637,812 B2 * 10/2003 Laughlin ..... A47C 4/028 297/118
6,715,837 B2 * 4/2004 Niederman ..... A47C 13/005 297/440.14 X
6,758,450 B2 * 7/2004 Niederman ..... A47C 13/005 297/440.16
6,827,407 B2 * 12/2004 Niederman ..... A47C 4/02 297/440.14
7,020,911 B2 * 4/2006 Oldham ..... A47C 7/546 297/440.1 X
7,140,690 B2 * 11/2006 White ..... A47C 4/03 297/440.14
7,188,908 B2 * 3/2007 White ..... A47C 4/02 297/440.14
7,387,344 B2 * 6/2008 Yu ..... A47C 4/028 297/440.1
7,480,947 B2 * 1/2009 Patella ..... F16B 12/60 297/440.23 X
9,226,583 B1 * 1/2016 Hibbard ..... A47C 7/546
9,532,651 B2 * 1/2017 Chung ..... A47C 7/42
11,202,507 B1 * 12/2021 Yi ..... A47C 4/028
11,297,949 B1 * 4/2022 Galjour ..... A47C 4/028
11,406,192 B1 * 8/2022 Wu ..... A47C 7/42
11,457,742 B1 * 10/2022 Zhang ..... A47C 4/02
11,484,122 B2 * 11/2022 Chen ..... A47C 13/005
11,766,128 B2 * 9/2023 Stack ..... A47C 7/42 297/440.1
11,864,662 B2 * 1/2024 Mackert ..... F16B 12/26
12,029,320 B1 * 7/2024 Zhao ..... A47C 7/546
12,035,806 B1 * 7/2024 Zhao ..... A47C 7/383
12,070,131 B2 * 8/2024 Nelson ..... A47C 4/02
12,082,705 B2 * 9/2024 Eglinton ..... A47C 13/005
12,102,232 B1 * 10/2024 Zhao ..... A47C 1/024
12,171,338 B1 * 12/2024 Zhao ..... A47C 1/032
12,285,114 B2 * 4/2025 Lee ..... A47C 7/546
12,318,014 B2 * 6/2025 Caron ..... A47C 7/30
12,342,970 B1 * 7/2025 Chen ..... A47C 4/02
2005/0225153 A1 * 10/2005 Ou ..... A47C 17/00 297/440.14
2006/0033368 A1 * 2/2006 Longnecker ..... A47C 13/005 297/248
2009/0189419 A1 * 7/2009 Wu ..... A47C 4/03 297/16.2
2010/0264715 A1 * 10/2010 Griggs, Jr. ..... A47C 4/028 297/440.1
2011/0254341 A1 * 10/2011 Potter ..... A47C 4/02 297/440.1
2012/0212021 A1 * 8/2012 Hunter ..... A47C 4/028 297/232 X
2021/0068547 A1 * 3/2021 Hodgson ..... A47C 7/42
2024/0090671 A1 * 3/2024 Berkowitz ..... A47C 7/42
2024/0206625 A1 * 6/2024 Ding ..... A47C 4/021
2024/0358156 A1 * 10/2024 Wu ..... A47C 7/546
2024/0415285 A1 * 12/2024 Browne ..... A47C 4/021
2025/0040712 A1 * 2/2025 Eglinton ..... A47C 4/02
2025/0241449 A1 * 7/2025 Zheng ..... A47C 17/161

FOREIGN PATENT DOCUMENTS

EP 2145567 A1 * 1/2010 ..... A47C 4/02
EP 2374374 A1 * 10/2011 ..... A47C 13/005
EP 3804570 A1 * 4/2021 ..... A47C 4/028
FR 2699058 A1 * 6/1994 ..... A47C 4/02
JP 3185571 U * 8/2013 ..... A47C 13/005
KR 102666816 B1 * 5/2024 ..... A47C 20/027

* cited by examiner

SOFA

CROSS-REFERENCE TO RELATED APPLICATIONS

The application claims priority of Chinese patent application CN202521352302 5, filed on Jun. 27, 2025, which is incorporated herein by reference in its entireties.

TECHNICAL FIELD

The present invention relates to the technical field of sofas, particularly to a sofa.

BACKGROUND ART

A sofa refers to a multi-seat chair equipped with soft cushions, which is usually used in living rooms or lounges for multiple people to sit or lie on. Sofas come in a variety of designs, with various shapes, sizes, materials and styles to meet different home decoration needs and comfort preferences. The main structure of a sofa is usually made of wood, metal or plastic, while the seat cushions and backrests are commonly filled with foam, down, or other soft materials to enhance comfort. The external covering materials of sofas are also very diverse, such as leather, fabric, artificial leather, etc., and each material has its unique touch and appearance effect.

In the prior art, after a user purchases a sofa, the manufacturer usually completes the assembly in the factory and then transports the entire sofa to the user's place of use, or the manufacturer sends staff to assemble the sofa on-site, thereby delivering the sofa with a fixed structure to the user. However, since the structure of the sofa is fixed, users cannot replace sofa components such as cushions and armrests anytime and anywhere according to different scenarios or personal preferences. Therefore, the existing sofas have poor versatility and cannot meet people's pursuit of personalized life.

SUMMARY

In order to overcome the shortcomings of the prior art, the present invention provides a sofa. The sofa includes a base, an armrest, and a mounting bracket. The armrest is positioned on the base. The mounting bracket is used for connecting the armrest to the base, so that the armrest and the base are combined into a whole.

As an improvement of the present invention, a first fixing band is provided on the armrest. Two ends of the first fixing band are respectively disposed on a side surface of the armrest. A first sleeving opening is formed between the first fixing band and the armrest. A bottom portion of the mounting bracket abuts against a bottom surface of the base. A side wall of the mounting bracket abuts against a side surface of the base and is disposed inside the first sleeving opening.

As an improvement of the present invention, the mounting bracket includes a first support portion and a second support portion. The first support portion is connected to the second support portion through a bending portion.

As an improvement of the present invention, the mounting bracket is in an "L" shape as a whole.

As an improvement of the present invention, the first support portion is disposed on a bottom surface of the base, and the second support portion abuts against a side surface of the base and a side surface of the armrest, so that the armrest and the base are combined into a whole.

As an improvement of the present invention, the first support portion includes a first shaft rod and a second shaft rod. The first shaft rod is connected to the second shaft rod through a first bending member.

As an improvement of the present invention, the first support portion further includes a third shaft rod. One end of the third shaft rod is connected to the first shaft rod through a second bending member. The third shaft rod is positioned symmetrically relative to the second shaft rod.

As an improvement of the present invention, the second support portion includes a first support rod and a second support rod. The first support rod is connected to the second support rod through a third bending member. The first support rod is positioned on an upper part of the first fixing band.

As an improvement of the present invention, the second support portion further includes a third support rod. One end of the third support rod is connected to the first support rod through a fourth bending member. The third support rod is positioned symmetrically relative to the second support rod.

As an improvement of the present invention, the bending portion includes a fifth bending member and a sixth bending member. Both the fifth bending member and the sixth bending member are in the shape of a right angle or an obtuse angle. One end of the fifth bending member is connected to the second shaft rod, and an opposite end of the fifth bending member is connected to the second support rod. One end of the sixth bending member is connected to the third shaft rod, and an opposite end of the sixth bending member is connected to the third support rod.

As an improvement of the present invention, the sofa further includes a back cushion. The back cushion is arranged on the base. The back cushion is provided with a first cushion portion and a second cushion portion. The first cushion portion and the second cushion portion are rotatably connected.

As an improvement of the present invention, the back cushion further includes a cushion case. The cushion case is provided with a first accommodating cavity, a second accommodating cavity, and a flexible connecting portion. The flexible connecting portion is positioned between the first accommodating cavity and the second accommodating cavity. The first cushion portion includes a first cushion core, and the second cushion portion includes a second cushion core. The first cushion core is disposed in the first accommodating cavity, and the second cushion core is disposed in the second accommodating cavity. The first accommodating cavity is provided with a first opening. The first opening is in communication with the first accommodating cavity. The first cushion core is capable of being placed into the first accommodating cavity through the first opening. The first opening is equipped with a first zipper. The first zipper is used for opening or closing the first opening. The second accommodating cavity is provided with a second opening. The second opening is in communication with the second accommodating cavity. The second cushion core is capable of being placed into the second accommodating cavity through the second opening. The second opening is provided with and a second zipper. The second zipper is used for opening or closing the second opening.

As an improvement of the present invention, the first cushion portion and the second cushion portion are rotatably connected through the flexible connecting portion. The cushion case can be made of polyurethane material. The first cushion core and the second cushion core are both compressed sponge inner cores.

As an improvement of the present invention, the sofa further includes a backrest. The backrest is arranged on the base. The backrest is provided with a top surface, a bottom surface, and a side surface connecting the top surface and the bottom surface. The bottom surface is connected to the base. A bottom surface of the first cushion portion abuts against the top surface. A bottom surface of the second cushion portion abuts against the side surface.

As an improvement of the present invention, the surfaces of the base, the armrest, the back cushion, and the backrest are all provided with protrusions.

As an improvement of the present invention, a fixing device is provided on the base. The second support rod and the third support rod both pass through the fixing device.

As an improvement of the present invention, the fixing device includes a second fixing band, and the base includes a first part. Two ends of the second fixing band are respectively disposed on a side surface of the first part. A second sleeving opening is formed between the second fixing band and the first part.

As an improvement of the present invention, the fixing device further includes a third fixing band. The base further includes a second part. Two ends of the third fixing band are respectively disposed on a side surface of the second part. A third sleeving opening is formed between the third fixing band and the second part.

As an improvement of the present invention, the first sleeving opening, the second sleeving opening, and the third sleeving opening are arranged in sequence. One end of the second support rod and one end of the third support rod pass through the first sleeving opening, the second sleeving opening, and the third sleeving opening in sequence and are connected to the first support rod.

As an improvement of the present invention, the back cushion is provided with an accommodating space. The back cushion is also provided with a partition portion. The partition portion divides the accommodating space into a first accommodating cavity and a second accommodating cavity that are not in communication with each other.

Beneficial effects of the present invention are as follows. The present invention provides the sofa. The sofa includes the base, the armrest, and the mounting bracket. The armrest is positioned on the base. The mounting bracket is used for connecting the armrest to the base, so that the armrest and the base are combined into a whole. The bottom portion of the mounting bracket abuts against the bottom surface of the base. The side wall of the mounting bracket abuts against the side surface of the base and the side surface of the armrest. The first support portion and the second support portion support the base and the armrest, preventing the armrest from detaching from the base and ensuring that the position of the armrest does not change arbitrarily.

BRIEF DESCRIPTION OF THE DRAWINGS

Implementations of the present disclosure will now be described, by way of embodiment, with reference to the attached figures. It should be understood, the drawings are shown for illustrative purpose only, for ordinary person skilled in the art, other drawings obtained from these drawings without paying creative labor by an ordinary person skilled in the art should be within scope of the present disclosure.

DETAILED DESCRIPTION OF THE EMBODIMENTS

Figure 1:
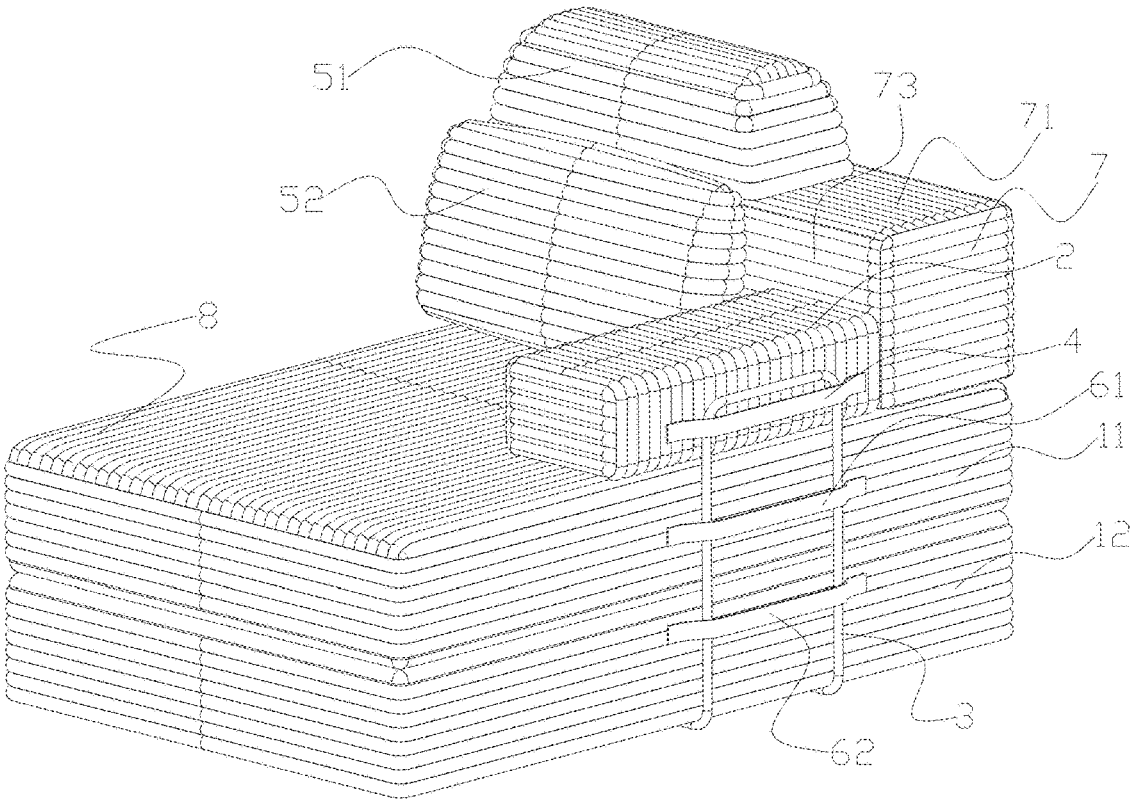
FIG. 1 is a schematic structural diagram of the present invention.

It will be appreciated that for simplicity and clarity of illustration, where appropriate, reference numerals have been repeated among the different figures to indicate corresponding or analogous elements. In addition, numerous specific details are set forth in order to provide a thorough understanding of the exemplary embodiments described herein. However, it will be understood by those of ordinary skill in the art that the exemplary embodiments described herein may be practiced without these specific details. In other instances, methods, procedures, and components have not been described in detail so as not to obscure the related relevant feature being described. Also, the description is not to be considered as limiting the scope of the exemplary embodiments described herein. The drawings are not necessarily to scale and the proportions of certain parts may be exaggerated to better illustrate details and features of the present disclosure.

The term "comprising" when utilized, means "including, but not necessarily limited to"; it specifically indicates open-ended inclusion or membership in the so-described combination, group, series, and the like. The disclosure is illustrated by way of example and not by way of limitation in the figures of the accompanying drawings in which like references indicate similar elements. It should be noted that references to "an" or "one" embodiment in this disclosure are not necessarily to the same embodiment, and such references can mean "at least one". In addition, the terms "first" and "second" are used for descriptive purposes only and cannot be understood as indicating or implying relative importance or implying the number of indicated technical features. Thus, the features defined as "first" and "second" may explicitly or implicitly include one or more of the features. In the description of embodiments of the application, "a plurality of" means two or more, unless otherwise specifically defined.

Figure 2:
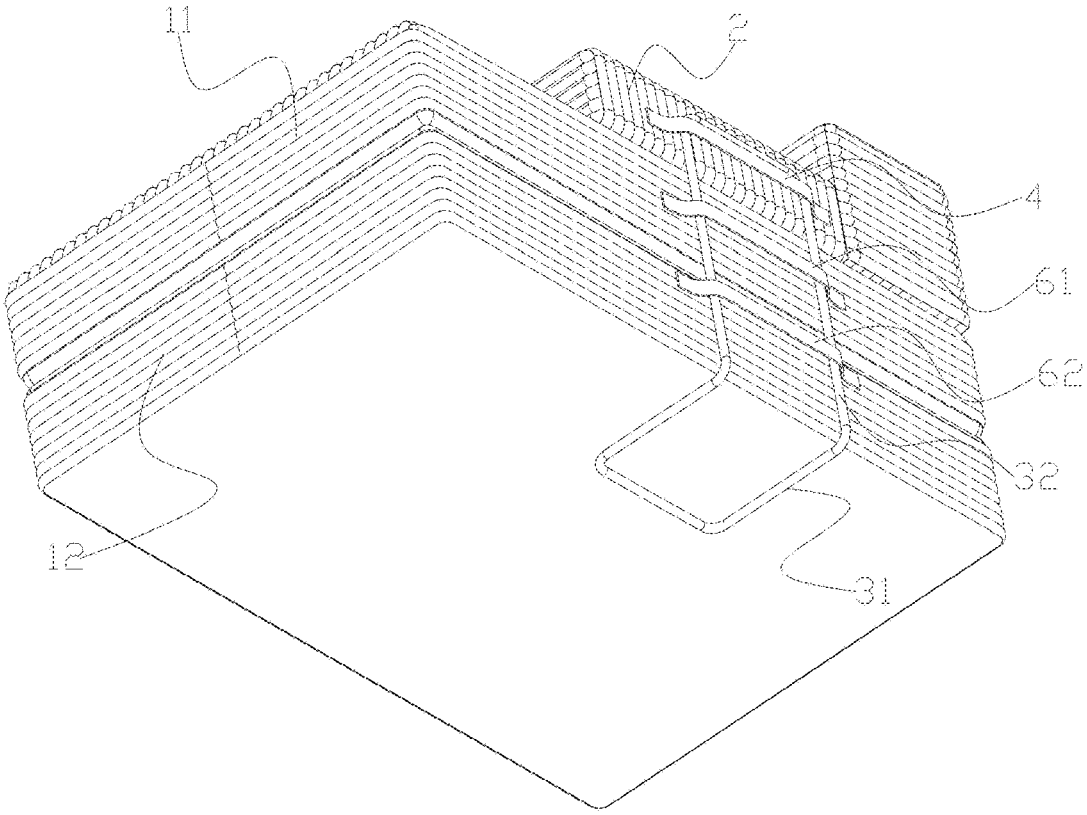
FIG. 2 is a schematic structural diagram of the present invention from another angle.
Figure 3:
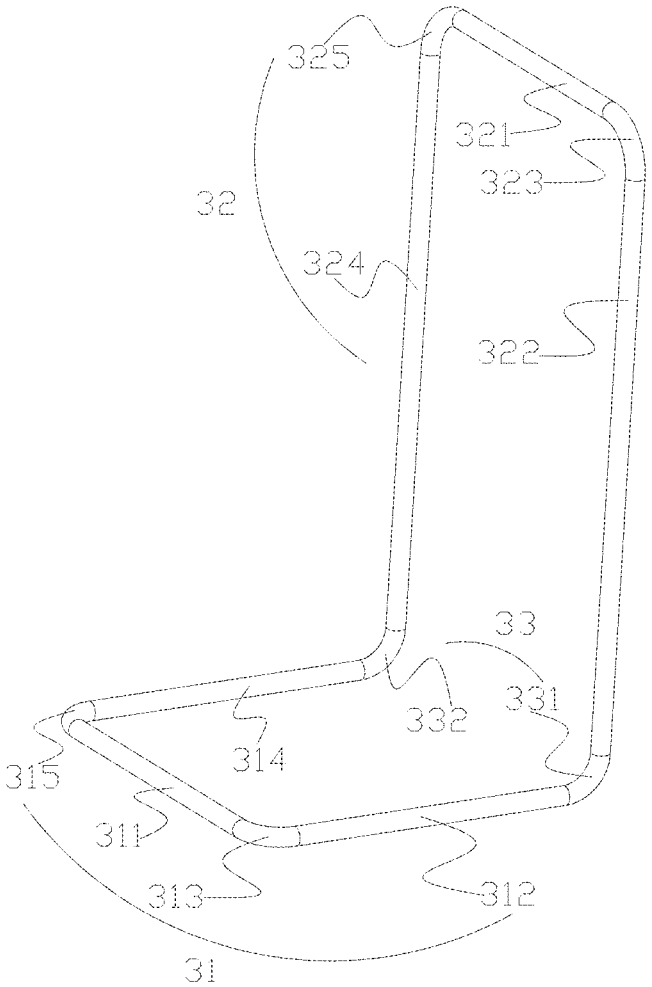
FIG. 3 is a schematic structural diagram of a mounting bracket of the present invention.
Figure 4:
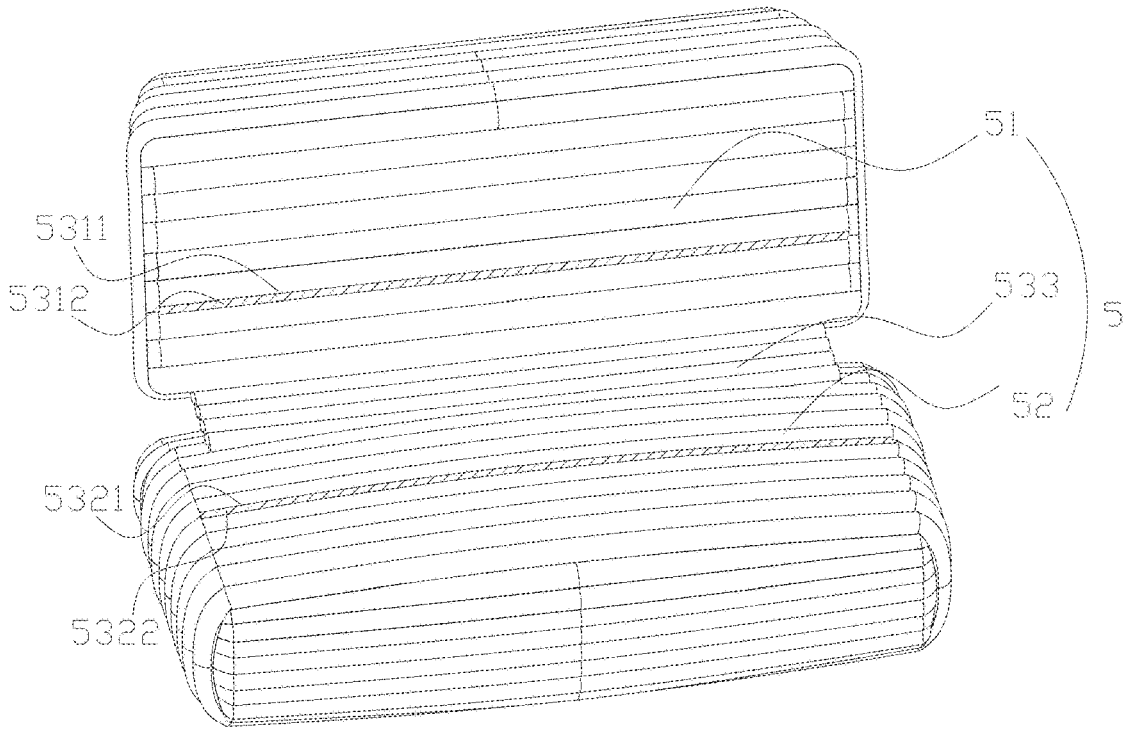
FIG. 4 is a schematic structural diagram of a back cushion of the present invention.
Figure 5:
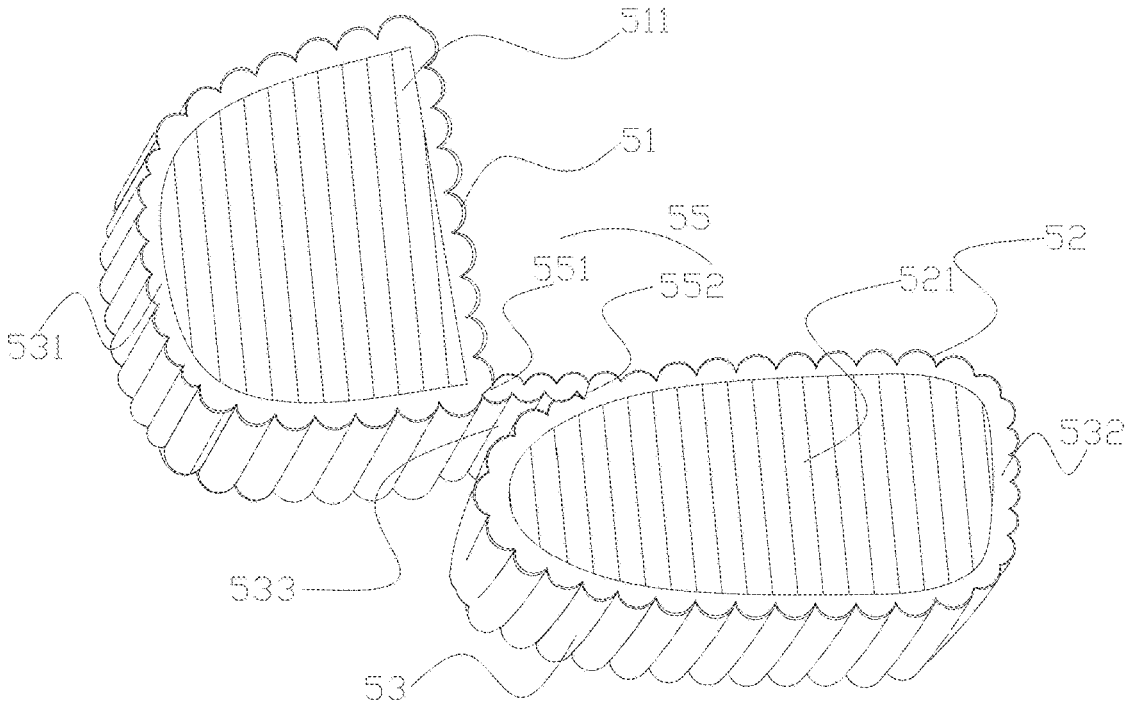
FIG. 5 is a cross-sectional view of a back cushion of the present invention.
Figure 6:
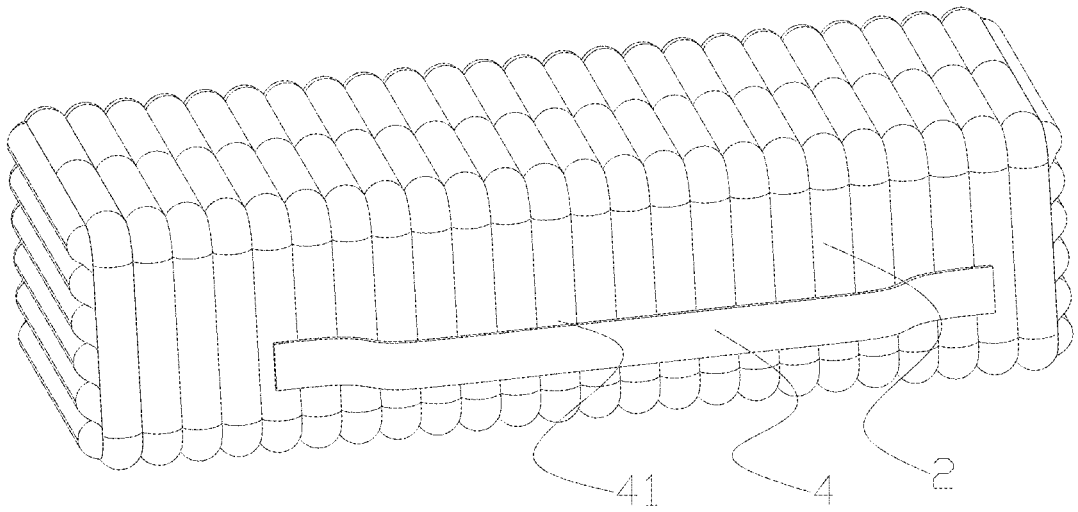
FIG. 6 is a schematic structural diagram of an armrest and a first fixing band according to the present invention.
Figure 7:
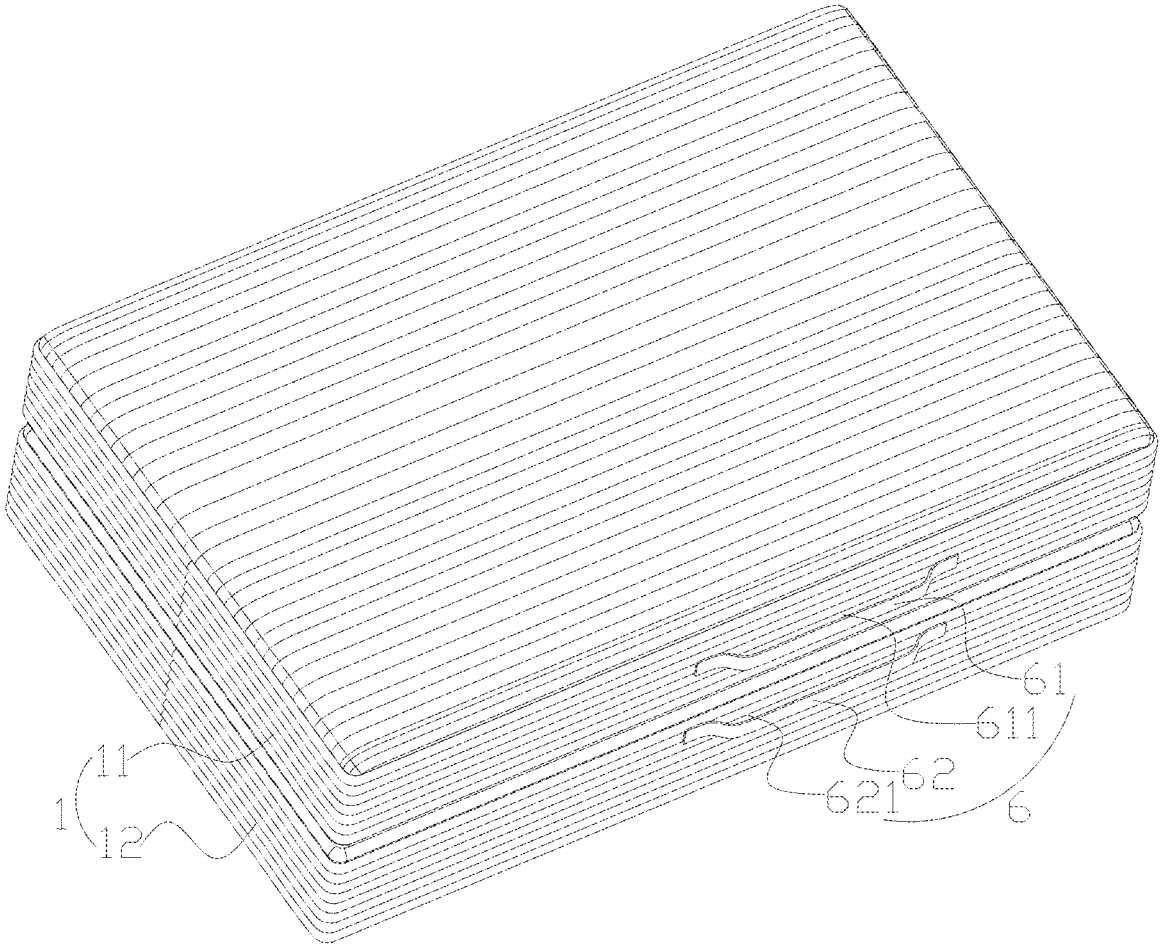
FIG. 7 is a schematic structural diagram of a base and a fixing device of the present invention.
Figure 8:
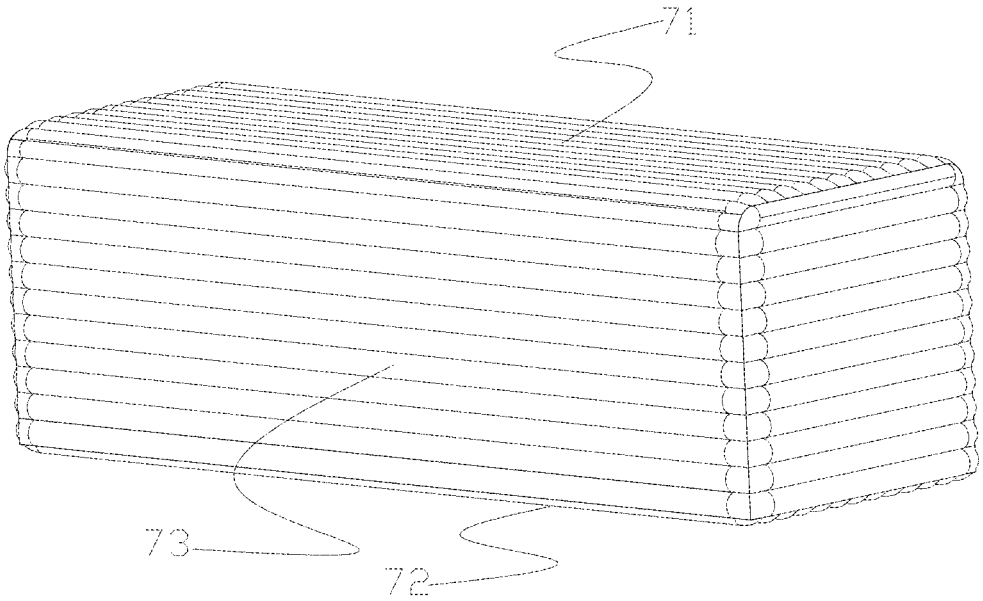
FIG. 8 is a schematic structural diagram of a backrest according to the present invention.

Referring to FIGS. 1-8, a sofa includes a base 1, an armrest 2, and a mounting bracket 3. The armrest 2 is positioned on the base 1. The mounting bracket 3 is used for connecting the armrest 2 to the base 1, so that the armrest 2 and the base 1 are combined into a whole. A length of the armrest 2 is less than a length of the base 1, allowing the armrest 2 to be placed on the base 1.

Through the above structure, a bottom portion of the mounting bracket 3 abuts against a bottom surface of the base 1. A side wall of the mounting bracket 3 abuts against the a side surface of the base 1 and a side surface of the armrest 2. The mounting bracket 3 combines the armrest 2 and the base 1 into a whole, and the mounting bracket 3 can limit a position of the armrest 2.

In this embodiment, a first fixing band 4 is provided on the armrest 2. Two ends of the first fixing band 4 are respectively disposed on the side surface of the armrest 2. A first sleeving opening 41 is formed between the first fixing band 4 and the armrest 2. The bottom portion of the mounting bracket 3 abuts against the bottom surface of the base 1. The side wall of the mounting bracket 3 abuts against the side surface of the base 1 and is disposed inside the first sleeving opening 41. One end of the mounting bracket 3 passes through the first sleeving opening 41 and is placed on one side of the armrest 2, thereby combining the armrest 2 and the base 1 into a whole.

In this embodiment, the mounting bracket 3 includes a first support portion 31 and a second support portion 32. The first support portion 31 is connected to the second support portion 32 through a bending portion 33. By using the first support portion 31 and the second support portion 32 to support the base 1 and the armrest 2, the armrest 2 will not detach from the base 1, and the position of the armrest 2 will not change arbitrarily. The mounting bracket 3 is in an "L" shape as a whole, and a length of the first support portion 31 is less than a length of the second support portion 32. The first support portion 31 is disposed on the bottom surface of the base 1, and the second support portion 32 abuts against the side surface of the base 1 and the side surface of the armrest 2, so that the armrest 2 and the base 1 are combined into a whole.

In this embodiment, the first support portion 31 includes a first shaft rod 311 and a second shaft rod 312. The first shaft rod 311 is connected to the second shaft rod 312 through a first bending member 313. The first support portion 31 further includes a third shaft rod 314. One end of the third shaft rod 314 is connected to the first shaft rod 311 through a second bending member 315. The third shaft rod 314 is positioned symmetrically relative to the second shaft rod 312. The first shaft rod 311, the second shaft rod 312, and the third shaft rod 314 are all disposed at the bottom portion of the base 1. The base 1 applies pressure to the first shaft rod 311, the second shaft rod 312 and the third shaft rod 314, so that the first shaft rod 311, the second shaft rod 312, and the third shaft rod 314 do not generate displacement, and also play a role in limiting the second support portion 32.

In this embodiment, the second support portion 32 includes a first support rod 321 and a second support rod 322. The first support rod 321 is connected to the second support rod 322 through a third bending member 323. The first support rod 321 is positioned on an upper part of the first fixing band 4. The first support rod 321 is positioned above the first fixing band 4, so that the first fixing band 4 will not easily detach from the second support rod 322 and the third support rod 324. The second support portion 32 further includes a third support rod 324. One end of the third support rod 324 is connected to the first support rod 321 through a fourth bending member 325. The third support rod 324 is positioned symmetrically relative to the second support rod 322. One end of the second support rod 322 and one end of the third support rod 324 are connected to the bending portion 33. An opposite end of the second support rod 322 and an opposite end of the third support rod 324 both pass through the first fixing band 4 and are connected to the first support rod 321, so that the base 1 and the armrest 2 form a whole. For better comfort, the base 1 and the armrest 2 can also be made of soft materials. When a user sits on the sofa, the base 1 will sag. The first support portion 31 and the second support portion 32 can reduce the degree of collapse of the sofa.

In this embodiment, the bending portion 33 includes a fifth bending member 331 and a sixth bending member 332. Both the fifth bending member 331 and the sixth bending member 332 are in the shape of a right angle or an obtuse angle. One end of the fifth bending member 331 is connected to the second shaft rod 312, and an opposite end of the fifth bending member 331 is connected to the second support rod 322. One end of the sixth bending member 332 is connected to the third shaft rod 314, and an opposite end of the sixth bending member 332 is connected to the third support rod 324. The fifth bending member 331 and the sixth bending member 332 abut against a junction between a bottom surface and a side surface of the second part 12. The first support portion 31 and the second support portion 32 fix the positions of the first part 11, the second part 12, and the armrest 2, and can also be combined in various ways. By changing the lengths of the first support portion 31 and the second support portion 32, the base 1 can be combined with a plurality of parts and a plurality of armrests 2.

In this embodiment, the sofa further includes a back cushion 5. The back cushion 5 is arranged on the base 1 and positioned on one side of the armrest 2. The back cushion 5 is provided with a first cushion portion 51 and a second cushion portion 52. The first cushion portion 51 and the second cushion portion 52 are rotatably connected. The first cushion portion 51 and the second cushion portion 52 are rotatably connected by a flexible connecting portion 533. The connection shape of the first cushion portion 51 and the second cushion portion 52 can be changed to improve the comfort and usage modes of the back cushion 5 for the user.

In this embodiment, the back cushion 5 further includes a cushion case 53. The cushion case 53 is provided with a first accommodating cavity 531, a second accommodating cavity 532, and a flexible connecting portion 533. The flexible connecting portion 533 is positioned between the first accommodating cavity 531 and the second accommodating cavity 532. The first cushion portion 51 includes a first cushion core 511, and the second cushion portion 52 includes a second cushion core 521. The first cushion core 511 is disposed in the first accommodating cavity 531, and the second cushion core 521 is disposed in the second accommodating cavity 532. The first accommodating cavity 531 is provided with a first opening 5311. The first opening 5311 is in communication with the first accommodating cavity 531. The first cushion core 511 is capable of being placed into the first accommodating cavity 531 through the first opening 5311. The first opening 5311 is equipped with a first zipper 5312. The first zipper 5312 is used for opening or closing the first opening 5311. The second accommodating cavity 532 is provided with a second opening 5321. The second opening 5321 is in communication with the second accommodating cavity 532. The second cushion core 521 is capable of being placed into the second accommodating cavity 532 through the second opening 5321. The second opening 5321 is provided with and a second zipper 5322. The second zipper 5322 is used for opening or closing the second opening 5321. The cushion case 53 can be made of polyurethane material. The first cushion core 511 and the second cushion core 521 are both compressed sponge inner cores. The cushion case 53 is detachably arranged. The first cushion core 511 can be taken out from the first accommodating cavity 531 for replacement, and the second cushion core 521 can be taken out from the second accommodating cavity 532 for replacement. Moreover, the cushion case 53 can also be arranged as a whole. The flexible connecting portion 533 can be a gap portion formed by placing the first cushion core 511 in the first accommodating cavity 531 and the second cushion core 521 in the second accommodating cavity 532.

In this embodiment, the back cushion 5 is also provided with a partition portion 55. The partition portion 55 separates an upper part of the back cushion 5 from a portion of a middle part of the back cushion 5. The partition portion 55 separates a lower part of the back cushion 5 from a portion of the middle part of the back cushion 5. The partition portion 55 includes a first partition portion 551 and a second partition portion 552. The first partition portion 551 separates the first accommodating cavity 531 from the flexible connecting portion 533. The second partition portion 552 separates the second accommodating cavity 532 from the flexible connecting portion 533.

In this embodiment, the back cushion 5 is provided with an accommodating space. The back cushion 5 is also provided with a partition portion 55. The partition portion 55 divides the accommodating space into a first accommodating cavity 531 and a second accommodating cavity 532 that are not in communication with each other. The partition portion 55 includes a first partition portion 551 and a second partition portion 552. The the first partition portion 551 and the second partition portion 552 are respectively positioned on both sides of the flexible connecting portion 533. A cavity is formed between the first partition portion 551 and the second partition portion 552. A volume of the cavity is smaller than a volume of the first accommodating cavity 531 and a volume of the second accommodating cavity 532. At least a portion of an upper surface of the back cushion 5 is connected to at least a portion of a lower surface of the back cushion 5 to form the partition portion 55. At least a portion of the upper surface of the back cushion 5 is connected to at least a portion of the lower surface of the back cushion 5 by stitching to form the partition portion 55.

In this embodiment, the sofa further includes a backrest 7. The backrest 7 is arranged on the base 1. The backrest 7 is provided with a top surface 71, a bottom surface 72, and a side surface 73 connecting the top surface 71 and the bottom surface 72. The bottom surface 72 is connected to the base 1. A bottom surface of the first cushion portion 51 abuts against the top surface 71. A bottom surface of the second cushion portion 52 abuts against the side surface 73. When the user sits on the sofa and leans against the backrest 7, the back cushion 5 can provide good cushioning, increasing the user's comfort. The surfaces of the base 1, the armrest 2, the back cushion 5, and the backrest 7 are all provided with protrusions 8. The protrusions 8 are arranged in a wave shape in sequence, increasing the user's comfort experience.

In this embodiment, a fixing device 6 is provided on the base 1. The second support rod 322 and the third support rod 324 both pass through the fixing device 6. The fixing device 6 includes a second fixing band 61, and the base 1 includes a first part 11. Two ends of the second fixing band 61 are respectively disposed on a side surface of the first part 11. A second sleeving opening 611 is formed between the second fixing band 61 and the first part 11. The second support rod 322 and the third support rod 324 both pass through the second sleeving opening 611 and are placed outside the second sleeving opening 611. The fixing device 6 further includes a third fixing band 62. The base 1 further includes a second part 12. Two ends of the third fixing band 62 are respectively disposed on a side surface of the second part 12. A third sleeving opening 621 is formed between the third fixing band 62 and the second part 12. The second support rod 322 and the third support rod 324 both pass through the third sleeving opening 621, are placed outside the third sleeving opening 621, and are connected to the first support rod 321. The first sleeving opening 41, the second sleeving opening 611, and the third sleeving opening 621 are arranged in sequence. One end of the second support rod 322 and one end of the third support rod 324 pass through the first sleeving opening 41, the second sleeving opening 611, and the third sleeving opening 621 in sequence and are connected to the first support rod 321, so that the base 1 and the armrest 2 form a whole.

The above description only describes embodiments of the present disclosure, and is not intended to limit the present disclosure; various modifications and changes can be made to the present disclosure. Any modifications, equivalent substitutions, and improvements made within the spirit and scope of the present disclosure are intended to be included within the scope of the present disclosure.

What is claimed is:

1. A sofa, comprising:

a base;

an armrest, wherein the armrest is positioned on the base; and a mounting bracket, wherein the mounting bracket is used for connecting the armrest to the base, so that the armrest and the base are combined into a whole;

wherein a first fixing band is provided on the armrest; two ends of the first fixing band are respectively disposed on a side surface of the armrest; a first sleeving opening is formed between the first fixing band and the armrest; a bottom portion of the mounting bracket abuts against a bottom surface of the base; and a side wall of the mounting bracket abuts against a side surface of the base and is disposed inside the first sleeving opening.

2. The sofa according to claim 1, wherein the mounting bracket comprises a first support portion and a second support portion; and the first support portion is connected to the second support portion through a bending portion.

3. The sofa according to claim 2, wherein the mounting bracket is in an "L" shape as a whole.

4. The sofa according to claim 2, wherein the first support portion is disposed on a bottom surface of the base; and the second support portion abuts against a side surface of the base and a side surface of the armrest, so that the armrest and the base are combined into a whole.

5. The sofa according to claim 4, wherein the first support portion comprises a first shaft rod and a second shaft rod; and the first shaft rod is connected to the second shaft rod through a first bending member.

6. The sofa according to claim 5, wherein the first support portion further comprises a third shaft rod; one end of the third shaft rod is connected to the first shaft rod through a second bending member; and the third shaft rod is positioned symmetrically relative to the second shaft rod.

7. The sofa according to claim 6, wherein the second support portion comprises a first support rod and a second support rod; the first support rod is connected to the second support rod through a third bending member; and the first support rod is positioned on an upper part of the first fixing band.

8. The sofa according to claim 7, wherein the second support portion further comprises a third support rod; one end of the third support rod is connected to the first support rod through a fourth bending member; and the third support rod is positioned symmetrically relative to the second support rod.

9. The sofa according to claim 8, wherein the bending portion comprises a fifth bending member and a sixth bending member; both the fifth bending member and the sixth bending member are in the shape of a right angle or an obtuse angle; one end of the fifth bending member is connected to the second shaft rod; an opposite end of the fifth bending member is connected to the second support rod; one end of the sixth bending member is connected to the third shaft rod; and an opposite end of the sixth bending member is connected to the third support rod.

10. The sofa according to claim 8, wherein a fixing device is provided on the base; and the second support rod and the third support rod both pass through the fixing device.

11. The sofa according to claim 10, wherein the fixing device comprises a second fixing band; the base comprises a first part; two ends of the second fixing band are respectively disposed on a side surface of the first part; and a second sleeving opening is formed between the second fixing band and the first part.

12. The sofa according to claim 11, wherein the fixing device further comprises a third fixing band; the base further comprises a second part; two ends of the third fixing band are respectively disposed on a side surface of the second part; and a third sleeving opening is formed between the third fixing band and the second part.

13. The sofa according to claim 12, wherein the first sleeving opening, the second sleeving opening, and the third sleeving opening are arranged in sequence; one end of the second support rod and one end of the third support rod pass through the first sleeving opening, the second sleeving opening, and the third sleeving opening in sequence and are connected to the first support rod.

14. A sofa, comprising:

a base;

an armrest, wherein the armrest is positioned on the base; and a mounting bracket, wherein the mounting bracket is used for connecting the armrest to the base, so that the armrest and the base are combined into a whole;

the sofa further comprising a back cushion, wherein the back cushion is arranged on the base; the back cushion is provided with a first cushion portion and a second cushion portion; and the first cushion portion and the second cushion portion are rotatably connected.

15. The sofa according to claim 14, wherein the back cushion further comprises a cushion case; the cushion case is provided with a first accommodating cavity, a second accommodating cavity, and a flexible connecting portion; the flexible connecting portion is positioned between the first accommodating cavity and the second accommodating cavity; the first cushion portion comprises a first cushion core; the second cushion portion comprises a second cushion core; the first cushion core is disposed in the first accommodating cavity; the second cushion core is disposed in the second accommodating cavity; the first accommodating cavity is provided with a first opening; the first opening is in communication with the first accommodating cavity; the first cushion core is capable of being placed into the first accommodating cavity through the first opening; the first opening is equipped with a first zipper; the first zipper is used for opening or closing the first opening; the second accommodating cavity is provided with a second opening; the second opening is in communication with the second accommodating cavity; the second cushion core is capable of being placed into the second accommodating cavity through the second opening; the second opening is provided with and a second zipper; and the second zipper is used for opening or closing the second opening.

16. The sofa according to claim 15, wherein the first cushion portion and the second cushion portion are rotatably connected through the flexible connecting portion; the cushion case can be made of polyurethane material; and the first cushion core and the second cushion core are both compressed sponge inner cores.

17. The sofa according to claim 14, further comprising a backrest, wherein the backrest is arranged on the base; the backrest is provided with a top surface, a bottom surface, and a side surface connecting the top surface and the bottom surface; the bottom surface is connected to the base; a bottom surface of the first cushion portion abuts against the top surface; a bottom surface of the second cushion portion abuts against the side surface.

18. The sofa according to claim 17, wherein the surfaces of the base, the armrest, the back cushion, and the backrest are all provided with protrusions.

19. The sofa according to claim 14, wherein the back cushion is provided with an accommodating space; the back cushion is also provided with a partition portion; and the partition portion divides the accommodating space into a first accommodating cavity and a second accommodating cavity that are not in communication with each other.

* * * * *